US009784046B2

(12) United States Patent
Gajji et al.

(10) Patent No.: US 9,784,046 B2
(45) **Date of Patent: *Oct. 10, 2017**

(54) METHODS AND APPARATUS FOR MITIGATING DOWNHOLE TORSIONAL VIBRATION

(71) Applicant: Halliburton Energy Services, Inc., Houston, TX (US)

(72) Inventors: Bhargav Gajji, Pune (IN); Rahul Ramchandra Gaikwad, Pune (IN); Puneet Agarwal, Pune (IN)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/195,421

(22) Filed: Jun. 28, 2016

(65) Prior Publication Data

US 2016/0305197 A1 Oct. 20, 2016

Related U.S. Application Data

(63) Continuation of application No. 14/418,299, filed as application No. PCT/US2013/049707 on Jul. 9, 2013, now Pat. No. 9,404,316.

(51) Int. Cl.
*E21B 17/07* (2006.01)
*E21B 19/24* (2006.01)
(Continued)

(52) U.S. Cl.
CPC ..... *E21B 17/1057* (2013.01); *E21B 17/07* (2013.01); *E21B 17/1078* (2013.01); *E21B 19/24* (2013.01); *E21B 47/12* (2013.01)

(58) Field of Classification Search
CPC .. E21B 17/07; E21B 17/1057; E21B 17/1078; E21B 19/24; E21B 47/12
See application file for complete search history.

(56) References Cited

U.S. PATENT DOCUMENTS 2,953,351 A 9/1960 Bodine
4,139,994 A 2/1979 Alther
(Continued)

FOREIGN PATENT DOCUMENTS

AR 096812 A1 2/2016
CN 105283626 A 1/2016
WO WO-2015005907 A1 1/2015

OTHER PUBLICATIONS

"U.S. Appl. No. 14/418,299, Final Office Action dated Feb. 25, 2016", 8 pgs.

(Continued)

*Primary Examiner* — Shane Bomar
*Assistant Examiner* — Christopher Sebesta
(74) *Attorney, Agent, or Firm* — Gilliam IP PLLC

(57) ABSTRACT

A well tool apparatus for damping torsional vibration of a drill string comprises stabilizing members projecting radially outwards from a housing that is, in operation, rotationally integrated in the drill string, to stabilize the drill string by engagement with a borehole wall. The stabilizing members are displaceably mounted on the housing to permit limited angular movement thereof relative to the housing about its rotational axis. The well tool apparatus includes a hydraulic damping mechanism to damp angular displacement of the stabilizing members relative to the housing, thereby damping torsional vibration of the housing and the connected drill string, in use.

18 Claims, 5 Drawing Sheets

(51) Int. Cl.
*E21B 17/10* (2006.01)
*E21B 47/12* (2012.01)

(56) References Cited

U.S. PATENT DOCUMENTS 4,582,145 A 4/1986 Salmi et al.
4,765,417 A 8/1988 Perkin et al.
5,372,548 A 12/1994 Wohlfeld
6,209,667 B1* 4/2001 Murray ..... E21B 17/105 175/228
6,244,361 B1 6/2001 Comeau et al.
6,250,394 B1 6/2001 Mashburn
6,808,455 B1 10/2004 Solorenko et al.
7,779,932 B2 8/2010 Hartung et al.
7,878,272 B2 2/2011 Eppink
7,997,357 B2 8/2011 Wassell et al.
8,205,691 B2 6/2012 Bowar et al.
2005/0011680 A1 1/2005 Egerstrom
2005/0098353 A1 5/2005 Maxwell et al.
2006/0124317 A1 6/2006 Telfer
2009/0023502 A1 1/2009 Koger
2009/0025982 A1 1/2009 Hall et al.
2010/0252274 A1* 10/2010 Buytaert ..... E21B 17/1028 166/380
2010/0326731 A1 12/2010 Swietlik et al.
2011/0120772 A1* 5/2011 McLoughlin ..... E21B 17/05 175/56
2012/0228028 A1* 9/2012 Turner ..... E21B 17/07 175/56
2013/0292183 A1* 11/2013 Eidem ..... E21B 17/105 175/325.5
2014/0262216 A1 9/2014 Perry
2015/0259989 A1 9/2015 Gajji et al.

OTHER PUBLICATIONS

"U.S. Appl. No. 14/418,299, Non Final Office Action dated Aug. 20, 2015", 9 pgs.
"U.S. Appl. No. 14/418,299, Notice of Allowance dated Mar. 31, 2016", 9 pgs.
"U.S. Appl. No. 14/418,299, Response dated Jan. 21, 2016 to Non Final Office Action dated Aug. 20, 2015", 11 pgs.
"U.S. Appl. No. 14/418,299, Response dated Mar. 14, 2016 to Final Office Action dated Feb. 25, 2016", 9 pgs.
"Australian Application Serial No. 2013393872, First Examiner Report dated Feb. 26, 2016", 3 pgs.
"International Application Serial No. PCT/US2013/049707, International Preliminary Report on Patentability dated Jan. 21, 2016", 8 pgs.
"International Application Serial No. PCT/US2013/049707, International Search Report dated Feb. 20, 2014", 4 pgs.
"International Application Serial No. PCT/US2013/049707, Written Opinion dated Feb. 20, 2014", 6 pgs.
"Canadian Application Serial No. 2,912,963, Office Action dated Sep. 9, 2016", 3 pgs.
"Chinese Application Serial No. 201380077294.1, First Office Action dated Jul. 27, 2016", W/ English Translation, 7 pages.
"Chinese Application Serial No. 201380077294.1, Second Office Action dated Mar. 1, 2017", 5 pages.
"Norway Application Serial No. 20151727; Office Action dated Jun. 23, 2017.", 4 pages (including English translation).

* cited by examiner

FIG. 5
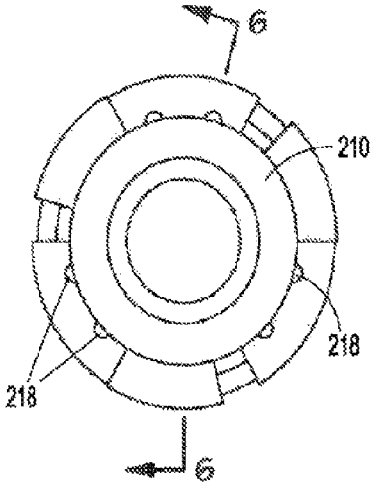
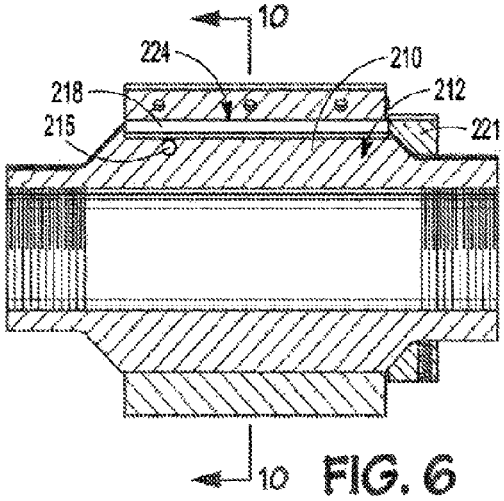
FIG. 6
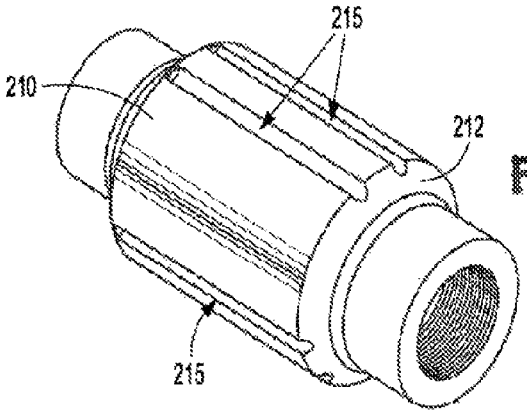
FIG. 7
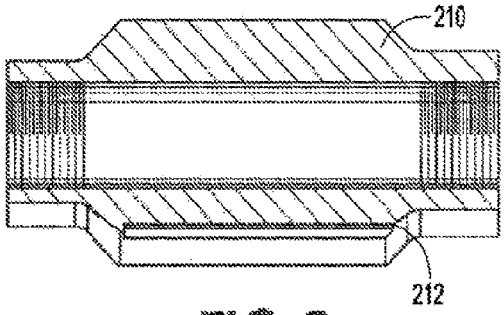
FIG. 9
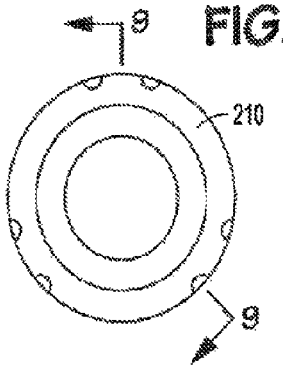
FIG. 8

METHODS AND APPARATUS FOR MITIGATING DOWNHOLE TORSIONAL VIBRATION

CLAIM OF PRIORITY

This application is a continuation application of U.S. patent application Ser. No. 14/418,299, filed on Jan. 29, 2015, which application is a U.S. National Stage Filing under 35 U.S.C. §371 of International Application PCT/US2013/049707, filed on Jul. 9, 2013, and published as WO 2015/005907 A1 on Jan. 15, 2015, which applications and publication are incorporated by reference herein in their entirety.

TECHNICAL FIELD

This application relates generally to methods and apparatus for mitigating downhole torsional vibration in a moving downhole tubular member, such as, in one example, in a drill string that is in rotation, such as during a drilling operation. Some embodiments relate more particularly to methods and apparatus to mitigate downhole torsional vibration in dull strings though use of hydraulic mechanisms to dampen such vibration.

BACKGROUND

Boreholes for hydrocarbon (oil and gas) production, as well as for other purposes, are usually drilled with a drill string that includes a tubular member (also referred to as a drilling tubular) having a drilling assembly which includes a drill bit attached to the bottom end thereof. The drill bit is rotated to shear or disintegrate material of the rock formation to drill the wellbore.

Torsional vibration in the drill string and in downhole drilling tools forming part of the drill string is an undesired phenomenon that often occurs during drilling. It can cause incidents which include but are not limited to twist-offs, back-offs, and bottom hole assembly (BHA) component failures. Torsional vibrations can also affect readings taken during measuring while drilling (MWD) operations.

Torsional vibration is typically caused by variations in the rotational speed (RPM) of the rotating assembly comprising the drill string, often experienced as stick-slip phenomena. Stick-slip behavior can be induced by a number of causes, including lateral vibrations and changes in rock formation type.

Lateral vibrations can cause a drill bit box and/or drill string stabilizers to make contact with a borehole wall to a varying extent. Friction between the drill string and the formation resulting from contact with the wellbore by these components often causes fluctuations in speed, exciting torsional vibration in the drill string. Similarly, fluctuations in the hardness of the formation along the borehole can vary the extent to which full gauge stabilizers in the drill string can rotate freely, thus intermittently varying the drill string's rotational speed. Such fluctuations in rotational speed of the drill string, as well as torsional shock impulses propagated along the drill string due to torsional vibration and/or associated stick-slip phenomena is detrimental to the structural integrity of drill string components and can cause or hasten failure of drill string components.

BRIEF DESCRIPTION OF THE DRAWINGS

Some embodiments are illustrated by way of example and not limitation in the figures of the accompanying drawings in which:

FIG. 5 is a schematic end view of a drilling apparatus in accordance with the example embodiment of FIG. 3.

FIG. 6 is a schematic longitudinal section of a drilling apparatus in accordance with the example embodiment of FIG. 3, taken along line 6-6 in FIG. 5.

FIG. 7 is a schematic three-dimensional view of a splined hub to form part of a drilling apparatus in accordance with an example embodiment.

FIG. 8 is a schematic end view of the example splined hub of FIG. 7.

FIG. 9 is a schematic longitudinal section of the splined hub of FIGS. 7 and 8, taken along line 9-9 in FIG. 8.

DETAILED DESCRIPTION

The following detailed description describes example embodiments of the disclosure with reference to the accompanying drawings, which depict various details of examples that show how the disclosure may be practiced. The discussion addresses various examples of novel methods, systems and apparatuses in reference to these drawings, and describes the depicted embodiments in sufficient detail to enable those skilled in the art to practice the disclosed subject matter. Many embodiments other than the illustrative examples discussed herein may be used to practice these techniques. Structural and operational changes in addition to the alternatives specifically discussed herein may be made without departing from the scope of this disclosure.

In this description, references to "one embodiment" or "an embodiment," or to "one example" or "an example" in this description are not intended necessarily to refer to the same embodiment or example; however, neither are such embodiments mutually exclusive, unless so stated or as will be readily apparent to those of ordinary skill in the art having the benefit of this disclosure. Thus, a variety of combinations and/or integrations of the embodiments and examples described herein may be included, as well as further embodiments and examples as defined within the scope of all claims based on this disclosure, as well as all legal equivalents of such claims.

According to one embodiment, the disclosure provides a full gauge stabilizer with stabilizer members mounted on the drill string to stabilize the drill string against a borehole wall, the stabilizer members being circumferentially slidable on the drill string to a limited extent, with a hydraulic damping mechanism acting on the stabilizing members to damp circumferential movement of the drill string relative to the stabilizing members, thus damping torsional vibration of the drill string.

Figure 1:
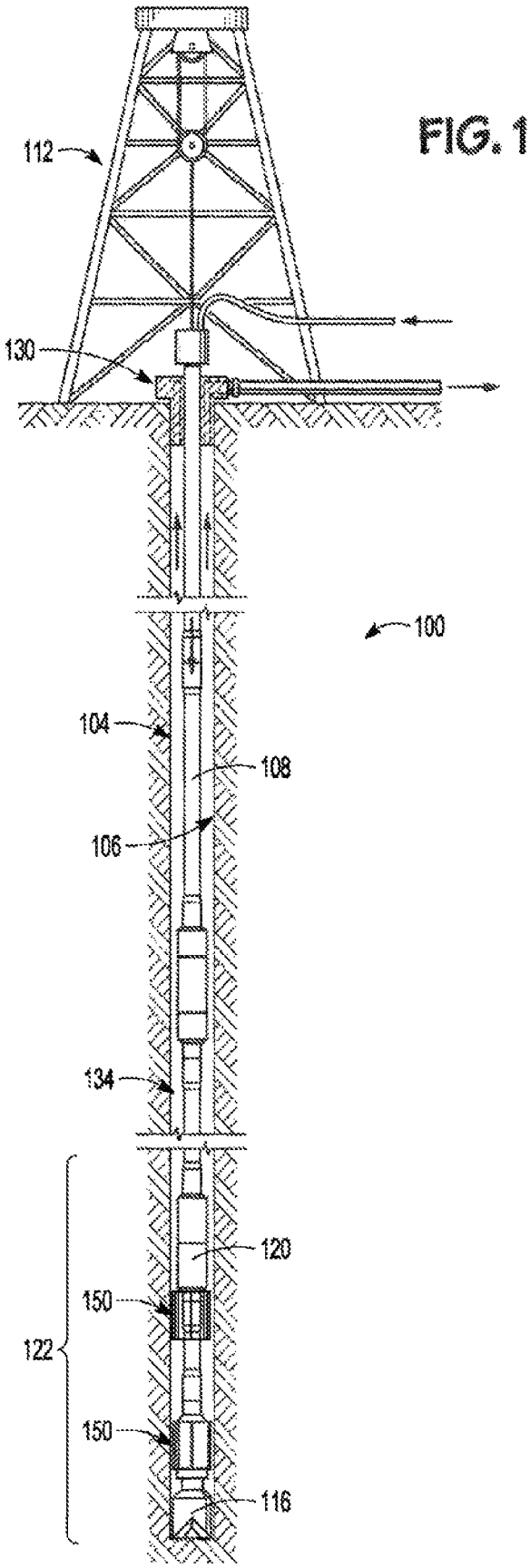
FIG. 1 depicts a schematic diagram of a drilling installation including a drilling apparatus that provides downhole torsional vibration mitigation, in accordance with an example embodiment.

FIG. 1 is a schematic view of a drilling installation 100 that includes an example embodiment of a downhole torsional vibration mitigation mechanism provided, in this example, by a drilling apparatus in the example form of a stabilizer device 150 incorporated in a drill string 108. The drilling installation 100 includes a subterranean borehole 104 in which the drill string 108 is located. The drill string 108 may comprise jointed sections of drill pipe suspended from a drilling platform 112 secured at a wellhead 130. A downhole assembly or bottom hole assembly (BHA) 122 at a bottom end of the drill string 108 may include a drill bit 116 to disintegrate earth formations at a leading end of the drill string 108, to pilot the borehole 104. The drill string 108 may further include one or more reamers (not shown) uphole of the drill bit 116, to widen the borehole 104.

The borehole 104 is thus an elongated cavity that is substantially cylindrical, having a substantially circular cross-sectional outline that remains more or less constant along the length of the borehole 104. The borehole 104 may in some cases or for some parts along its length be rectilinear, but may often include one or more curves, bends, doglegs, or angles along its length. As used with reference to the borehole 104 and components therein, the longitudinal axis or "axis" of the borehole 104 (and therefore of the drill string 108 or part thereof) means the centerline of the cylindrical borehole 104. "Axial" as used herein thus means a direction along a line substantially parallel with the lengthwise direction of the borehole 104 at the relevant point or portion of the borehole 104 under discussion.

Related terms indicating directions of movement are relative to the axis of the borehole 104, unless otherwise stated or unless the context indicates otherwise. "Radial," for example, means a direction substantially along a line that intersects the borehole axis and lies in a plane substantially perpendicular to the borehole axis. "Tangential" means a direction substantially along a line that does not intersect the borehole axis and that lies in a plane perpendicular to the borehole axis. "Circumferential" means a substantially arcuate or circular path described by rotation about the borehole axis at a substantially constant radius. The terms "rotational" or "angular" similarly refer to rotation, typically at a constant radius, about the longitudinal axis. "Rotational" as used herein refers both to full rotation (i.e., through 360° or more) and to partial rotation.

Drilling fluid (e.g. drilling "mud," or other fluids that may be in the well), is circulated from a drilling fluid reservoir (for example a storage pit) coupled to the wellhead 130 by means of a pump that forces the drilling fluid down a drill string bore provided by a hollow interior of the drill string 108. The drilling fluid exits under high pressure through the drill bit 116. After exiting from the drill string 108, the drilling fluid occupies a borehole annulus 134 defined between a radially outer surface of the drill string 108 and a cylindrical borehole wall 106. The drilling fluid carries cuttings from the bottom of the borehole 104 to the wellhead 130, where the cuttings are removed and the drilling fluid may be returned to the drilling fluid reservoir 132.

In some instances, the drill bit 116 is rotated by rotation of the drill string 108 from the wellhead 130. A downhole motor (for example a so-called mud motor or turbine motor forming part of the BHA 122) may rotate the drill bit 116. In some embodiments, rotation of the drill string 108 may be selectively powered by one or both of surface equipment and the downhole motor.

The system 102 may include a surface control system to receive signals from sensors and devices incorporated in the drill string 108, and to send control signals to control devices and tools incorporated in the drill string 108. To this end, the drill string 108 may include a measurement and control assembly 120, in this example incorporated in the BHA 122.

Figure 2:
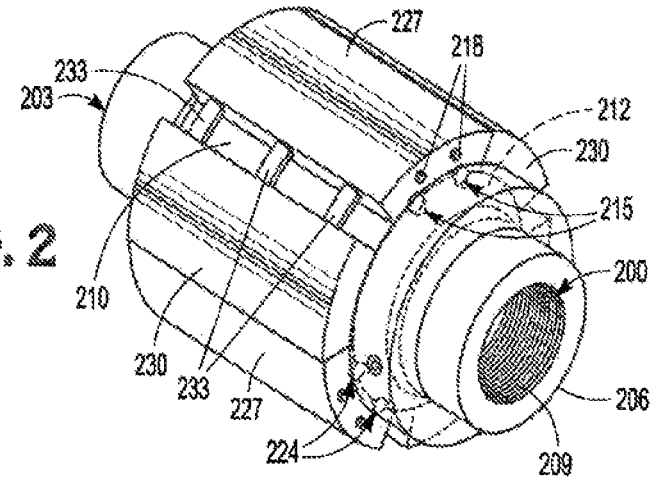
FIGS. 2-4 depict schematic three-dimensional views of a drilling apparatus that comprises a drill string stabilizer with an integrated torsional vibration mitigation mechanism, in accordance with an example embodiment, circumferentially movable stabilizing members being shown in FIG. 4 to be angularly displaced relative to their positions in FIGS. 2 and 3.

The example stabilizer device 150 will now be described in more detail with reference to FIGS. 2-11, whereafter its operation in use will be discussed. Turning now to FIG. 2, the stabilizer device 150 in accordance with this example embodiment is shown to comprise a generally tubular hub 203 that is mountable in-line in the drill string 108 to rotate with the drill string 108. A number of blade elements in the example form of three fixed blades 227 are mounted on the hub 203, being rotationally keyed to the hub 203 to resist relative rotation of the fixed blades 227 relative to the hub 203. The fixed blades 227 are circumferentially spaced around the hub 203 at regular intervals, forming circumferentially spaced, generally longitudinally extending, openings between them.

A stabilizing member in the example form of a movable pad 230 mounted in each of the openings, projecting radially outwards from the hub 203 to engage the borehole wall 106 for spacing the hub 203, and therefore the drill string 108, at a constant radial distance from the borehole wall 106, thereby providing lateral stabilization of the drill string 108. The movable pads 230 are mounted on the hub 203 such that they are angularly displaceable relative to the hub 203 about its longitudinal axis.

The movable pads 230 are smaller in angular extent than the corresponding openings and are thus mounted in the openings with angular clearance, defining a consistent cumulative angular gap between the circumferential ends of each movable pad 230 and the fixed blades 227 adjacent to it. As will be described more extensively below, the movable pads 230 are rotationally displaceable relative to the fixed blades 227 and project radially further from the hub 203 than the fixed blades 227, to engage the borehole wall 106, in operation. A shock absorption or vibration isolation mechanism is provided between the movable pads 230 and the fixed blades 227, to damp torsional vibration of the drill string 108. Engagement of one or more of the movable pads 230 with the borehole wall 106 provides transient or temporary anchor points that facilitates vibration damping force transfer to the hub 203 (and therefore to the drill string 108) via the fixed blades 227.

The hub 203 has a hollow tubular body that defines a central bore 200 that forms an in-line segment of the bore of the drill string 108, when the stabilizer device 150 is connected to the drill string 108. The hub 203 has tubular end formations 206 at its opposite ends, each end formation 206 providing a threaded socket 209 for screwing engagement with neighboring sections of the drill string 108. The threaded sockets 209 thus provide connection formations to mount the hub 203 to the drill string 108 for driven rotation with the drill string 108.

The hub 203 provides a cylindrical seat 210 on which the fixed blades 227 and the movable pads 230 are mountable, the seat 210 being defined by a raised surface that protrudes radially from the tubular end formations 206. Turning briefly to FIG. 7, which shows the hub 203 in isolation, it will be seen that a seat surface provide by the radially outer cylindrical surface of the seat 210 provides a plurality of keying formations in the example form of longitudinally extending flutes 215 that are part-circular in cross-section. In this example embodiment, a pair of circumferentially spaced flutes 215 is provided for each fixed blade 227.

Returning now to FIG. 2, it can be seen that the respective fixed blades 227 each has a pair of channels 224 that match the spacing and diameter of the flutes 215. In this example embodiment, each fixed blade 227 comprises part-annular cylindrical body that has apart-cylindrical radially outer bearing surface 236 to engage the borehole wall 106, in use, and has a concentric part-cylindrical inner surface for saddle-fashion reception on the seat 210. The channels 224 are provided in the inner surface of the fixed blade 227, so that an elongated cylindrical cavity is defined when a flute 215 and matching channel 224 are in register.

An elongated circular cylindrical dowel pin 218 that is complementary to both the flutes 215 and the channels 224 is received in each flute 215, rotationally keying the corresponding fixed blade 227 to the hub 203.

As can be seen with reference to FIGS. 6-8, the hub 203 provides a stopper formation 618 in the example form of a raised part-conical collar at one end of the seat 210. The stopper formation 618. In this example embodiment serves dual functions. First, the stopper formation 618 provides an axial shoulder against which the fixed blades 227 abut, to restrict axial movement of the fixed blades 227 off the seat 210 at that end. Secondly, the stopper formation 618 closes off the corresponding ends of the flutes 215, to form a blind end 612 (see FIG. 6) of the flutes 215 at the ends thereof corresponding to the stopper formation 618. Opposite ends of the flutes 215 (and therefore of the composite pin cavities defined by the flutes 215 and channels 224 together) are open, providing mouth 606 of the composite cavities.

The stabilizer device 150 further comprises a lock ring 221 that is clamped to a cylindrical outer surface of the end formation 206 opposite the stopper formation 618, abutting against corresponding ends of the fixed blades 227. The fixed blades 227 are thus axially sandwiched between the stopper formation 618 and the lock ring 221, being held axially captive on the seat 210. The lock ring 221 also covers the mouths 606 of the pin cavities, keeping the dowel pins 218 in their cavities.

Mounting of the fixed blades 227 on the seat 210 may thus in use comprise placement of the dowel pins 218 in their respective flutes 215 such that inner ends of the dowel pins 218 rest against the 618, sliding of the fixed blades 227 over axially over the seat 210 such that the dowel pins 218 slide axially along the channels, and clamping of the lock ring 221 into position to retain the fixed blades 227 and the dowel pins 218 on the seat 210. Note that the opposite ends of the movable pads 230 may be axially spaced from the lock ring 221 and from the stopper formation 618, to permit angular movement of the movable pads 230 relative to the hub 203.

Angular or rotational movement of the movable pads 230 relative to the hub 203 in a circumferential direction is guided by part-circular or arcuate pistons 233 that are slidably received in complementary mating fluid cylinders 304. (see, e.g., FIG. 3). In this example, each movable pad 230 provides three axially spaced, substantially parallel integrated pistons 233 projecting circumferentially from each of its sides, thus having six pistons 233 in total. The curved pistons 233 (and the co-operating curved cylinder 304) are shaped and positioned such that they are concentric with the longitudinal axis of the hub 203. Guided angular movement of the movable pad 230 is thus along a part-circular path concentric with the longitudinal axis, sliding circumferentially across the seat 210.

Figure 3:
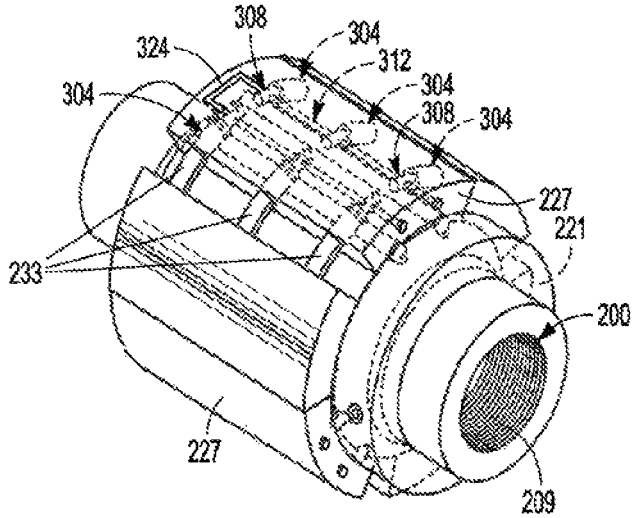
Figure 4:
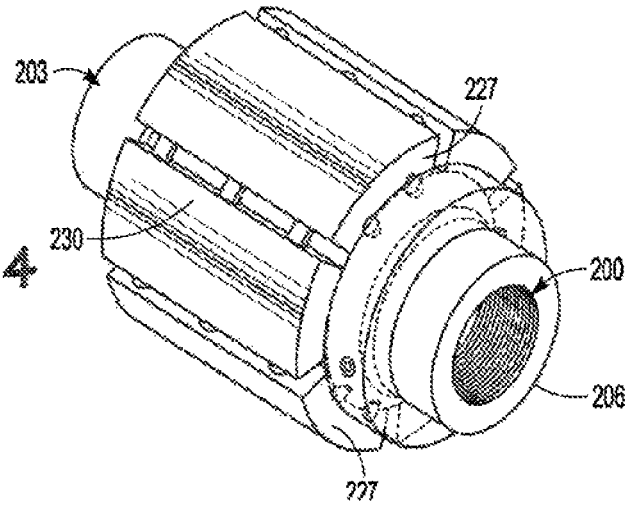

While each movable pad 230 has pistons 233 projecting from both its sides, each fixed blade 227 likewise has three cylinders 304 on each of its sides. Each radially facing side edge of each of the fixed blades 227 thus have circular openings leading into the respective cylinders 304, the corresponding pistons 233 being a sealing, sliding fit in the respective cylinders 304. As can be seen in FIG. 3, for example, each piston 233 is received spigot-socket fashion in the associated cylinder 304.

The fixed blade 227 defines, at an inner end of each cylinder 304, a fluid chamber 308 having a reduced cross-sectional dimension relative to a diameter of the associated cylinder 304. In this example embodiment, the fluid chamber 308 is cylindrical and is co-axial with the corresponding cylinder 304, having a smaller diameter than the cylinder 304 to form a constriction in a fluid flow path of which the cylinder 304 and the fluid chamber 308 form part. An annular shoulder 320 (best seen, e.g., in FIGS. 11 and 12) is formed at the inner end of the cylinder 304.

Returning briefly to FIG. 3, it will be seen that the fluid chambers 308 of each side of the fixed blade 227 are in fluid flow connection via an axially extending connection passage 312 passing through all three axially registering fluid chambers 308. The two connection passages 312 of each fixed blade 227 are in fluid flow communication with each other via a lateral connection passage 324. The connection passages 312 and the lateral connection passage 324 thereby effectively provide a common fluid reservoir to which all of the cylinders 304 and fluid chambers 308 of the fixed blade 227 are connected.

As will be described further herein, torsional vibration mitigation operation provided by the stabilizer device 150 is thus double-acting, as retraction of the pistons 233 from their cylinders 304 on one side of the fixed blade 227 may be effected by forced fluid transmission from the other side of the fixed blade 227 due to forced movement of the pistons 233 on the other side of the fixed blade 227 further into their corresponding cylinders 304.

A disc-shaped damper plate 1005 (see for example FIGS. 10-12) is located in each cylinder 304. The damper plate damper plate 1005 has a diameter smaller than that of the cylinder 304, so that the damper plate 1005 is a loose fit in the cylinder 304. In this example embodiment, a difference between the diameter of damper plate 1005 and the diameter of cylinder 304 is sufficiently large to define an annular opening between the radially outer edge of the damper plate 1005 and a cylindrical wall of the cylinder 304.

The damper plate 1005 is, however, larger in diameter than the fluid chamber 308, so that passage of the damper plate 1005 into the fluid chamber 308 under pressure is prevented by seating of the damper plate 1005 on the annular shoulder provided at the inner end of the cylinder 304. The damper plate 1005 defines a nozzle or orifice 1010 to restrict hydraulic flow under pressure from the cylinder 304 to the fluid chamber 308. Each cylinder 304 and fluid chamber 308, together with the corresponding damper plate 1005 thus provides a dashpot-type damping device that damps movement of the movable pad 230 relative to the fixed blade 227 by restricting a fluid flow rate through the cylinder 304 to the maximum rate that can pass through the damper orifice 1010 for a given fluid pressure.

A spring bias device in the example form of a coil spring 316 is provided in each cylinder 304 (see, e.g., FIG. 10). The coil spring 316 held captive in the cylinder 304 between the damper plate 1005 and the piston 233. In this example embodiment, the coil spring 316 is loose in the cylinder 304, being free to slide lengthwise along the cylinder 304 until it abuts against the damper plate 1005 or an inner end of the piston 233.

In operation, one or more stabilizer devices 150 may be connected in-line in the drill string 108 to mitigate downhole torsional vibration of the drill string 108. A stabilizer device 150 may, for example, be connected as part of the BHA 122, immediately or closely behind the drill bit 116, and another stabilizer device 150 may be provided in proximity to the measurement and control assembly 120. Although FIG. 1 shows an example embodiment having two stabilizer devices 150 positioned along the drill string 108 to be proximate the drill bit 116 and the measurement and control assembly 120 respectively, the number and positioning of stabilizer devices 150 connected in the drill string 108 may be different in other embodiments.

Connection of the stabilizer device 150 to the drill string 108 is, in this example, by screwing engagement of the threaded sockets 209 of the hub 203 with complementary formations forming part of or attached to neighboring pipe sections of the drill string 108, so that the hub 203 serves as a pipe section of the drill string 108. When thus connected, the hub 203 and the fixed blades 227 are rotationally fixed with the drill string 108, rotating together with the drill string 108 without substantial relative rotational movement relative to the drill string 108.

Mounting of the fixed blades 227 and the movable pads 230 on the hub 203 may comprise placing the dowel pins 218 in respective flutes 215 on the seat 210, and sliding the telescopically connected fixed blades 227 and movable pads 230, as an annular unit, axially on to the seat 210, the fixed blades 227 being guided by dowel pins 218. The fixed blades 227 are thus keyed to the hub 203 by the dowel pins 218. Finally, the lock ring 221 is fastened to the hub 203, abutting against the edge of the seat 210 to lock the dowel pins 218 in place.

In other embodiments, stabilizing and vibration mitigation components similar or analogous to those of the example stabilizer device 150 can be mounted on any housing forming part of the drill string 108, typically to form part of the BHA 122, instead of being mounted on a dedicated housing such as that provided by the hub 203 in the example embodiment of FIG. 7-9. The system can thus be provided as an in-line stabilizer or as a sleeve which can be retrofitted anywhere in the drill string 108. In the present example, the selected housing need only define a fluted cylindrical portion such as the seat 210, to permit retrofitting of the co-operating fixed blades 227 and movable pads 230 on the housing.

In this example embodiment, the torsional vibration mitigation arrangement is provided on the stabilizer devices 150, which thus serve the dual function of lateral drill string stabilization and torsional vibration damping or mitigation. Note that other embodiments may be provided on a drill string component that does not additionally provide for drill string stabilization.

Stabilization functions of the stabilizer devices 150 are in this example provided mainly by the movable pads 230, due to their having a larger outer diameter than the fixed blades 27. The radially outer bearing surface 236 of one or more of the movable pads 230 may make sliding contact with the cylindrical borehole wall 106 (see for example FIG. 12), bearing against the borehole wall 106 to space the longitudinal axis of the drill string 108 a constant radial distance from the borehole wall 106. This serves to mechanically stabilize the BHA 122 in the borehole 104, to reduce unintentional sidetracking and lateral vibration.

Figure 12:
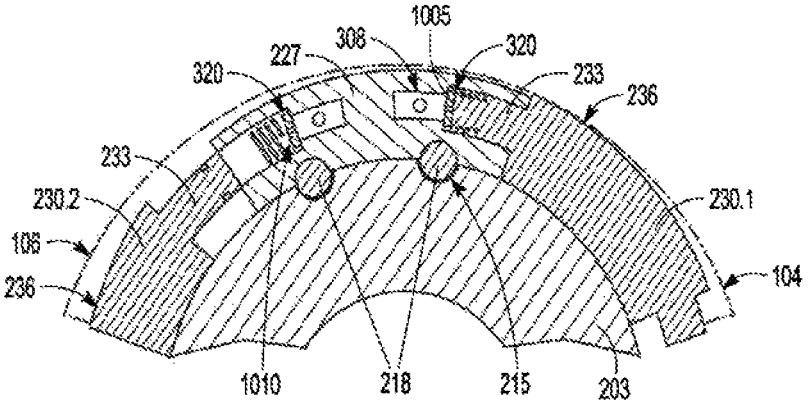

Note that although the diameter of the respective movable pads 230 is in this example smaller than the diameter of the borehole 104, as shown in FIG. 12, the stabilizer device 150 may in other embodiments be dimensioned such that the stabilizer device 150 more fully spans the width of the borehole 104, to center the drill string 108 in the borehole 104. The beating surfaces 236 of the movable pads 230 may furthermore be non-cylindrical in other embodiments, for example comprising spiral blades that may permit at least some axial fluid flow past the movable pad 230 white it is in rotationally sliding contact with the borehole 106.

Because the fixed blade 227 has a smaller outer diameter than the movable pad 230, the fixed blades 227 cannot contact the borehole wall 106 and therefore do not serve a lateral stabilization function in operation. Instead, the fixed blades 227 and hub 203 may be viewed as together providing a rotationally integral composite housing on which stabilizing members in the form of the movable pads 230 are mounted for limited relative rotational movement that is sprung and damped.

Because one or more of the movable pads 230 is in at least intermittent contact with the borehole wall 106, the movable pads 230 in use provides a temporarily or transiently fixed support for dampening torsional or rotational vibrations in the drill string 108. The movable pads 230 in other words serve to transfer vibration mitigating forces from the borehole wall 106 to the hub 203, via the fixed blades 227. At least a major component of these forces are transmitted to the fixed blades 227 via the springs 316, thus acting tangentially to apply a counter-vibrational moment to the hub 203, and therefore the BHA 122 at the axial position of the stabilizer device 150.

Figure 10A:
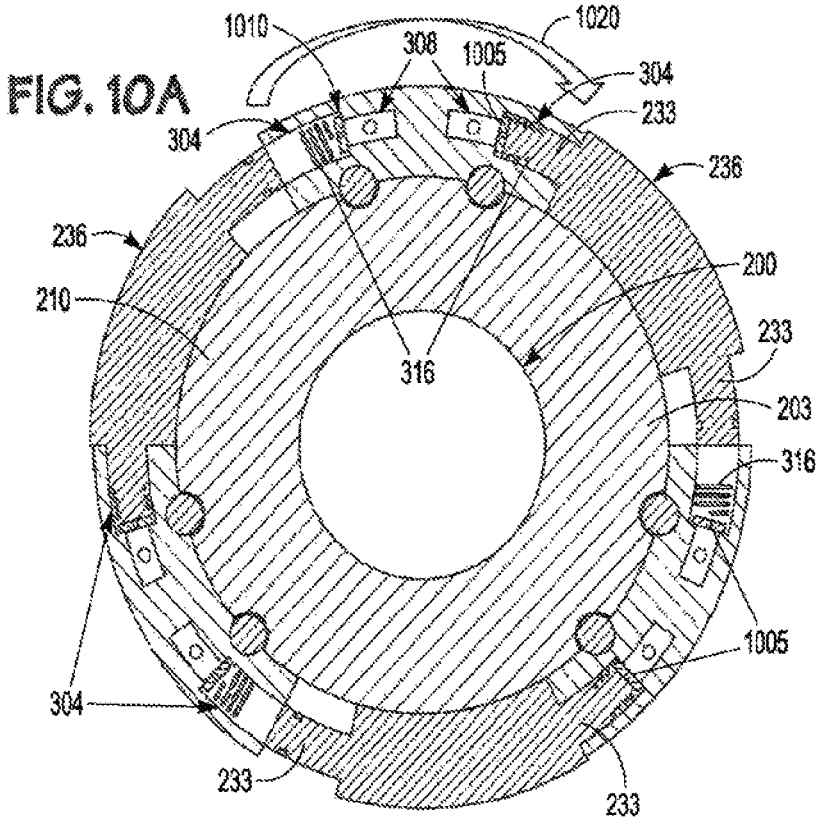
FIGS. 10A and 10B are schematic sectional end views of a drilling apparatus in accordance with an example embodiment.

Turning now to FIG. 10A, it can be seen that during rotation of the drill string 108 in the absence of substantial torsional vibration, each movable pad 230 will be in edge-to-edge contact with a neighboring fixed blade 227 that trails it in the direction of rotation (indicated by numeral 1020 in FIG. 10A), due to frictional drag on the movable pad 230 from the borehole wall 106 (see also FIG. 12).

When the drill string 108 vibrates torsionally during drill string rotation, the hub 203 (and therefore the rotationally connected fixed blades 227) will oscillate rotationally relative to the movable pads 230, rapidly moving backwards and forwards relative to the movable pads 230 in relation to the movable pads 230. FIGS. 10B-12 show a number of rotational positions of the fixed blades 227 relative to the movable pads 230 during torsional or rotational vibration.

A circumferential gap that varies in size with the torsional oscillation is created between each fixed blade 227 and its associated leading movable pad 230, against which the fixed blade 227 abuts during normal rotation. The double-acting hydraulic damping system of the stabilizer device 150 damps these vibrations by automatically applying counter-vibrational torque to the hub 203.

Figure 11:
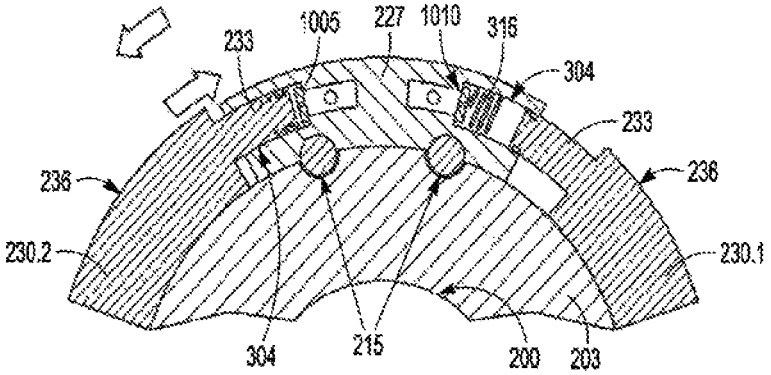
FIGS. 11 and 12 are respective partial end views of a drilling apparatus in accordance with an example embodiment, schematically illustrating operation of an example sprung damper arrangement forming part of the drilling apparatus to mitigate downhole torsional vibration.

Operation of the bi-directional or double-acting vibration mitigation mechanism will now be described with reference to FIGS. 11 and 12, considering one of the fixed blades 227 in isolation. For ease of description, the movable pads 230 on opposite sides of the fixed blade in FIGS. 11 and 12 are referred to as the leading pad 230.1 and the trailing pad 230.2.

In a forward stroke, when the leading pad 230.1 moves closer to the fixed blade 227 (i.e., towards its position in FIG. 10A and FIG. 12), the pistons 233 of the leading pad 230.1 are pushed further into the respective cylinders 304. Each piston 233 compresses the corresponding spring 316, which in turn forces the damper plate 1005 against the shoulder 320. The advancing pistons 233 also pressurize hydraulic oil in the oil-filled cylinders 304 forcing oil through the damper orifice 1010 and into the fluid chambers 308. Because of the damper plate 1005 is seated on the shoulder, the damper orifice 1010 is the sole passage for oil from the cylinder 304 to the associated fluid chamber 308. Restricted flow of the hydraulic oil from the cylinder 304 causes the oil to exert resistance to forward movement of the pistons 233, thus providing dashpot-fashion damping the forward stroke of the fixed blade 227.

As a result, a hydraulic damping force is exerted on the pistons 233 corresponds to the relative angular velocity of the relevant components. The greater the relative speed of the forward stroke, the greater is the opposing damping force provided by the cylinders 304 on the trailing side of the fixed blade 227. Additionally, the characteristics of springs 316 are selected so that a resistive force exerted by the springs 316 due to their elastic compression is small relative to the hydraulic damping forces, and may be of negligible relative magnitude. The primary function of the springs 316 in this example embodiment is to ensure proper location of the spring 316 on the shoulder 320 during the forward stroke, not to provide an elastic bias mechanism for movement of the movable pads 230 relative to the hub 203. The damping mechanism of the example stabilizer device 150 is thus substantially un-sprung.

Because the hydraulic oil is substantially incompressible, oil volume in the interconnected fluid system that includes the cylinders 304, fluid chambers 308, and connection passages 312 remains substantially constant. Pressurized liquid flows, during the forward stroke, from one end of the fixed blade 227 to the other, so that the decrease in volume of the cylinders 304 associated with the leading pad 230.1 causes a simultaneous corresponding increase in volume of the cylinders 304 associated with the trailing pad 230.2, on the other side of the fixed blade 227.

Figure 10B:
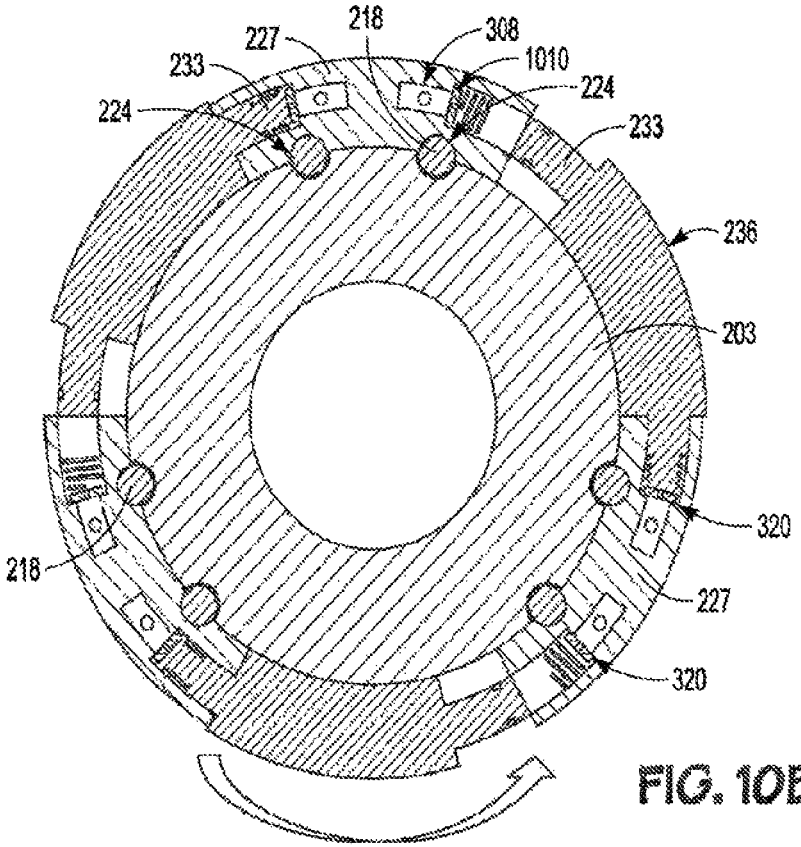

During the backward stroke of the hub 203's torsional vibration e.g., FIGS. 11 and 10B), the above-described process is mirrored, with the pistons 233 of the trailing pad 230.2 compressing the associated cylinders 304. The backward stroke is thus damped by restricted flow of pressurized hydraulic fluid through the damper orifices 1010 on an opposite side of the fixed blade 227 than is the case for damping of the forward stroke.

Hydraulic flow from the high-pressure cylinders 304 (e.g., from those cooperating with the trailing pad 230.2 in FIG. 11) to the low-pressure cylinders 304 on the other side of the fixed blade 227 (e.g., to those cooperating with the leading pad 230.1 in FIG. 11), is facilitated by the loose seating of the damper plate 1005 on the shoulder 320. A pressure differential over the damper plate 1005 from the fluid chamber 308 to the cylinder 304 force the damper plate 1005 off its shoulder 320, against the spring 316. When thus lifted, oil from the fluid chamber 308 can pass the damper plate 1005 not only through the damper orifice 1010, but also through an annular space around the circumference of the damper plate 1005. The stabilizer device 150 thus damps rotational and/or torsional vibration of the drill string 108 by means of bi-directional damping of hub movement relative to stabilizing elements in the example form of the movable pads 230, which bear against the borehole wall 106.

In many examples of the contemplated torsional vibration mitigation mechanisms and methods of use, the torsional vibration mitigation is largely independent on the operating conditions, such as temperature and pressure, so that the stabilizer device 150, e.g., has a wide window of suitable operating conditions. The stabilizer device 150 furthermore has low operating costs, being of simple and rugged construction.

In many examples of the contemplated stabilizer device, the operation will be purely mechanical, so that the stabilizer device 150 does not generate any electro-magnetic field that may interfere with adjacent drill string components. This allows placement of one or more stabilizer devices 150 in close proximity to potentially sensitive electronic/magnetic sensing and/or communication devices. In FIG. 1, for example, the upper stabilizer device 150 is located immediately adjacent the measurement and control assembly 120, without risk of electro-magnetic interference by the stabilizer device 150 on the measurement and control assembly 120. Due to the drill string 108's inherent torsional elasticity, the reduction or mitigation of rotational oscillation of the drill string 108 may decrease progressively away from the location of the stabilizer device 150 in the drill string 108. Electro-magnetic inertness of the stabilizer device 150 permits optimization of the stabilizer device 150's torsional vibration damping effects by allowing placement of the stabilizer device 150 right next to vibration sensitive equipment, such as measurement and control electronics.

Although the disclosure has been described with reference to specific example embodiments, it will be evident that various modifications and changes may be made to these embodiments without departing from the broader spirit and scope of method and/or system. Accordingly, the specification and drawings are to be regarded in an illustrative rather than a restrictive sense.

In the present description, it can be seen that various features are grouped together in a single embodiment for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims form a part of this description, with each claim standing on its own as a separate example embodiment.

What is claimed is:

1. An apparatus, comprising:

a housing having a longitudinal axis, the housing configured to co-axially couple to a drill string;

a stabilizing member projecting radially outward from the housing, the stabilizing member configured to engage a borehole wall to radially space the housing from the borehole wall;

a mounting assembly configured to mount the stabilizing member to the housing to permit relative angular displacement of the entirety of the stabilizing member about the housing central longitudinal axis, the mounting assembly configured to resist relative longitudinal displacement between the housing and the stabilizing member; and a hydraulic damping mechanism configured to damp relative angular displacement between the housing and the stabilizing member.

2. The apparatus of claim 1, wherein the mounting assembly comprises the damping mechanism.

3. The apparatus of claim 1, wherein the damping mechanism is configured to provide bi-directional damping of housing rotation relative to the stabilizing member by exerting a damping moment on the housing responsive to relative rotational movement of the housing in one direction, and to exert an oppositely oriented damping moment on the housing responsive to relative rotational movement of the housing in the opposite direction.

4. The apparatus of claim 1, wherein the damping mechanism comprises one or more dashpot mechanisms that respectively comprise a piston/cylinder arrangement configured to force hydraulic liquid under pressure through a flow restricting damper orifice responsive to rotation of the housing relative to the stabilizing member.

5. The apparatus of claim 4, wherein the damping mechanism for the stabilizing member comprises at least two dashpot mechanisms that have opposite rotational orientations, a first dashpot mechanisms configured to damp relative rotation in one direction, and a second dashpot mechanism configured to damp relative rotation in the other direction.

6. The apparatus of claim 4, wherein the housing comprises:

a tubular hub configured to rotate co-axially with the drill string; and a plurality of blade elements that are rotationally keyed to the hub and project radially outwards from the hub, the blade elements being arranged and dimensioned such that the stabilizing member is located with circumferential clearance between two neighboring blade elements, each piston/cylinder arrangement being provided cooperatively by the stabilizing member and an adjacent blade element.

7. The apparatus of claim 6, wherein the stabilizing member has a radially outer bearing surface to engage the borehole wall, an outer diameter of the bearing surface being greater than respective outer diameters of the plurality of blade elements.

8. The apparatus of claim 6, wherein each piston/cylinder arrangement comprises a curved piston carried by the stabilizing member and extending along a part-circumferential path, the curved piston being slidingly received in a complementary curved cylinder defined in the corresponding blade element.

9. The apparatus of claim 8, wherein each blade element provides one or more cylinders of respective piston/cylinder arrangements on one side of the blade element, relative to the rotational direction, and provides one or more cylinders of respective piston/cylinder arrangements on the other side of the blade element, the blade element further defining a fluid flow connection between the cylinders on the respective sides of the blade element.

10. The apparatus of claim 8, wherein each piston/cylinder arrangement includes a damper plate that defines the damper orifice and that is loosely located in the associated cylinder, the damper plate being held captive between the corresponding piston and an annular shoulder opposite the piston, so that hydraulic flow from the cylinder seats the damper plate on the shoulder and restricts flow to the damper orifice, while hydraulic flow into the cylinder, across the shoulder, lifts the damper plate from the annular shoulder.

11. The apparatus of claim 10, wherein a circumferential opening is defined between the damper plate and a wall of the cylinder, to permit hydraulic flow through the circumferential opening when the damper plate is lifted from the annular shoulder during hydraulic flow into the cylinder, across the shoulder.

12. A system, comprising:

an elongated drill string extending longitudinally along a borehole;

a housing co-axially connected to the drill string for rotation with the drill string, the housing having a central longitudinal axis;

a stabilizing member mounted to, and projecting radially outward from, the housing, the stabilizing member configured to move about the housing central longitudinal axis relative to the housing;

a displacement resistance mechanism arranged to resist relative longitudinal displacement between the housing and the stabilizing member; and a hydraulic damping mechanism configured to damp relative angular displacement between the housing and the stabilizing member.

13. The system of claim 12, wherein the hydraulic damping mechanism comprises one or more dashpot mechanisms that respectively comprise a piston/cylinder arrangement configured to force hydraulic liquid under pressure through a flow restricting damper orifice responsive to rotation of the housing relative to the stabilizing member, a relative rotational velocity of the housing and stabilizing member being limited by a rate of hydraulic flow through the damper orifice.

14. The system of claim 13, wherein the hydraulic damping mechanism comprises a first dashpot mechanism configured to damp relative rotation in a first direction, and a second dashpot mechanism configured to damp relative rotation in a second direction, opposite the first direction.

15. The system of claim 13, wherein the housing comprises:

a tubular hub to rotate co-axially with the drill string; and a plurality of blade elements that are rotationally keyed to the hub and project radially outwards from the hub, the blade elements being arranged and dimensioned such that the stabilizing member is located with circumferential clearance between two neighboring blade elements, each piston/cylinder arrangement being provided co-operatively by the stabilizing member and an adjacent blade element.

16. The system of claim 15, wherein each piston/cylinder arrangement comprises a curved piston carried by the respective stabilizing member and extending along a part-circumferential path, the curved piston being slidingly received in a complementary curved cylinder defined in the corresponding blade element.

17. The system of claim 16, wherein each blade element provides one or more cylinders of respective piston/cylinder arrangements on one side of the blade element, relative to the rotational direction, and provides one or more cylinders of respective piston/cylinder arrangements on the other side of the blade element, the blade element further defining a fluid flow connection between the cylinders on the respective sides of the blade element.

18. An apparatus, comprising:

a housing having a longitudinal axis, the housing configured to co-axially couple to a drill string;

at least one stabilizing member projecting radially outward from the housing, the at least one stabilizing member configured to engage a borehole wall to radially space the housing from the borehole wall;

a mounting assembly configured to mount the at least one stabilizing member to the housing to permit relative angular displacement of the entirety of the at least one stabilizing member about the housing central longitudinal axis, the mounting assembly configured to resist relative longitudinal displacement between the housing and the stabilizing member; and a hydraulic damping mechanism configured to damp relative angular displacement between the housing and the stabilizing member, so as to damp torsional vibration of the housing and the drill string.

* * * * *